United States Patent [19]

Kreyenbuhl

[11] 4,314,713

[45] Feb. 9, 1982

[54] BINDING FOR FASTENING A BOOT TO A SKI

[75] Inventor: Armand Kreyenbuhl, Samoens, France

[73] Assignee: Adidas Fabrique De Chaussures De Sport, Landersheim, France

[21] Appl. No.: 35,386

[22] Filed: May 2, 1979

[30] Foreign Application Priority Data

May 10, 1978 [FR] France ..... 7813880

[51] Int. Cl.[3] ..... A63C 9/18

[52] U.S. Cl. ..... 280/615; 36/117

[58] Field of Search ..... 280/615, 614, 623, 635, 280/611, 613; 36/117, 122, 125

[56] References Cited

U.S. PATENT DOCUMENTS 1,922,955 8/1933 Jensen ..... 280/615

3,003,777 10/1961 Hilding ..... 280/614

4,108,467 8/1978 Kreyenbuhl ..... 280/615

FOREIGN PATENT DOCUMENTS 327513 7/1935 Italy ..... 280/615

673948 11/1964 Italy ..... 280/613

*Primary Examiner*—Joseph F. Peters, Jr.

*Assistant Examiner*—Milton L. Smith

*Attorney, Agent, or Firm*—Brisebois & Kruger

[57] ABSTRACT

A ski binding in which a locking bar is rotatable between a locked and unlocked condition of the binding. In the unlocked condition the extension of the sole of a ski boot can be inserted into an archplate of the same height and width as the extension, with the bar passing through an inlet of extension to a position within an opening which is larger than the inlet. Angular movement of the bar to the locked position prevents withdrawal of the extension from the archplate.

8 Claims, 6 Drawing Figures

BINDING FOR FASTENING A BOOT TO A SKI

The present invention concerns a device for fastening a boot or shoe to a ski, especially a touring or cross-country ski, of the type in which the boot is held by an extension of the sole situated at the front of the boot, and in which the extension which is in one piece with the sole engages in an arch plate which is secured to the ski, and which defines a volume whose shape corresponds in width and height to that of the extension of the sole, the boot being fixed to the ski by a locking mechanism which immobilizes the extension of the sole in the arch plate.

The present invention relates to a fastening device furnished with a unique locking means to immobilize the extension of the sole in the arch plate and a ski boot designed to coact with such a device.

The object of the present invention is a fastening device of the above type in which the locking means comprises a pin or bar pivotal about a vertical axis and traversing the arch plate, the pin engaging in a recess in the forward extension of the sole when the boot is seated in the fastening device, the shapes of the recess and the pin being such that, in an angular locking position of the pin, the extension of the boot cannot be disengaged from the arch plate, while in another unlocking angular position of the pin, the extension of the sole can be disengaged from the arch plate.

In one particular embodiment, the pin is basically rectangular in section, while the recess at the front of the extension of the sole has the shape of a circular aperture whose diameter is slightly larger than the length or thickness of the long side of the rectangular section of the pin, the circular aperture merging at the front end of the extension of the sole with a slot whose width is slightly greater than the length or thickness of the small side of the rectangular section of the pin.

In one particular embodiment, the pin is pivoted for rotation in the upper horizontal portion of the arch plate and in the portion which is fastened to the ski, the pin having on its upper portion two small flanges or wings which allow it to be pivoted between locking and unlocking positions relative to the extension of the sole.

According to one preferred embodiment of the invention, a retention means, such as for example a boss which engages in a groove of corresponding shape, allows the pin to be held in the angular position which corresponds to locking.

Another object of the present invention is a ski boot designed to act with the fastening device described above, in which the forward extension of the sole is furnished with a recess opening toward the front whose shape is such that when the pin is in its unlocking position it can engage in and disengage from the recess and when the pin is in its locking position it cannot be disengaged from the recess thus ensuring the retention of the boot in the binding.

In order to make the invention better understood, there will now be described by way of illustration and without being in any way limiting, one embodiment taken as an example and shown on the attached drawing in which.

Figure 1:
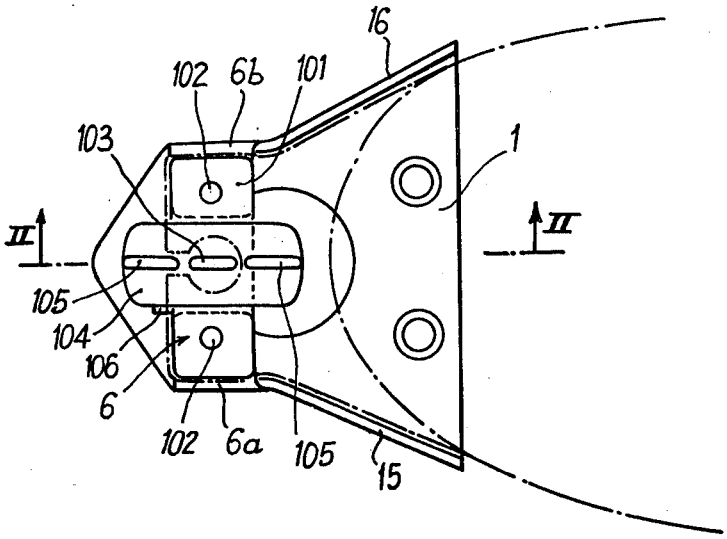
FIG. 1 is a view from above of a fastening device according to the invention in which the pin is placed in the unlocking position.
Figure 2:
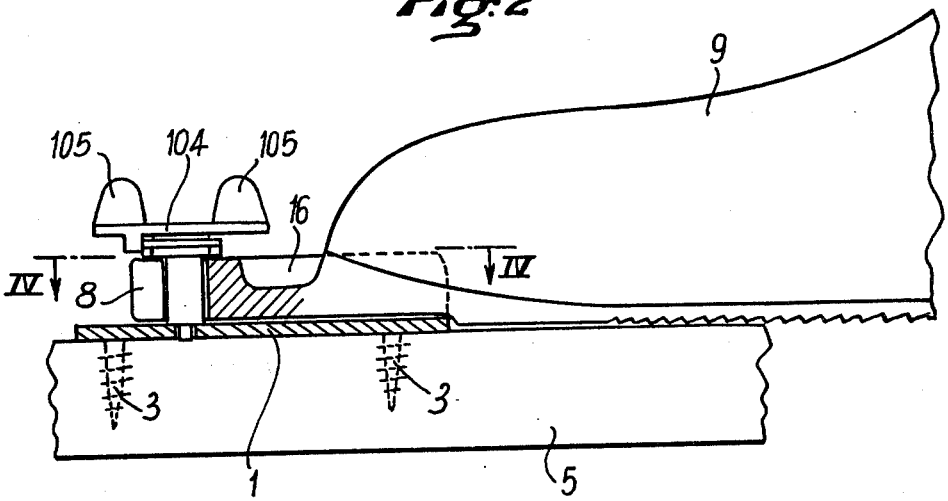
FIG. 2 is a partial view in section taken along II—II of FIG. 1.

The drawing shows plate 1 which supports arch plate 6 and which is fastened on ski by screws 3 through apertures in plate 1.

Arch plate 6 is extended toward the back by flanges 15 and 16.

Figure 6:
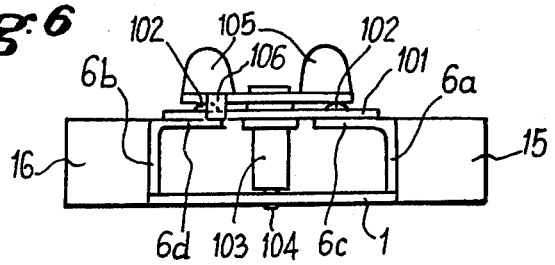
FIG. 6 is a view from the left corresponding to FIG. 3.

As FIG. 6 shows particularly, the arch plate is constituted by vertical portions 6*a* and 6*b* bent inwardly to form upper portion 6*c* and 6*d*.

A small plate 101 joins the two inwardly bent flanges 6*c* and 6*d*, and is fastened to these flanges by rivets 102. A pin or bar 103 extends through and is mounted to pivot in the small plate 101 at the upper end of the arch plate, and pivots in plate 1 on a cylindrical tip 104.

As the drawing shows, pin 103 has a flat rectangular section.

The upper portion of pin 103 has a small plate 104 with two wings 105 which enable the pin to be pivoted between its locking and unlocking positions.

In the unlocked position shown in FIG. 1, the large side of the reactangular section of the pin 103 is directed parallel to the axis of the boot and in alignment with wings 105.

Figure 3:
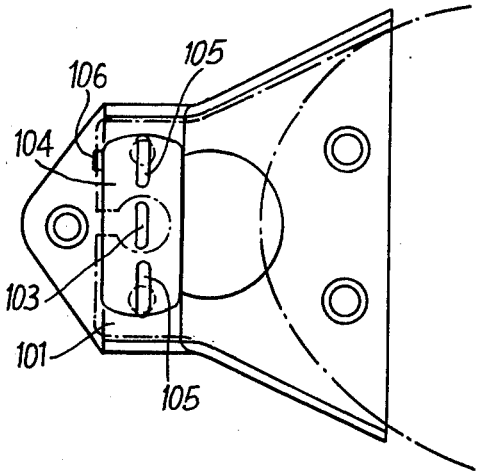
FIG. 3 is a view from above corresponding to FIG. 1, with the pin in the locking position.

In the position shown at FIG. 3, small plate 104 has been pivoted a quarter turn clockwise, so that pin 103 is placed perpendicular to the axis of the boot.

A lug 106 limits the angular movement of pin 103 by engaging against the upper portion of the arch plate.

In order to hold pin 103 in its locking position as shown in FIG. 6, the lower portion of small plate 104 has two indentations corresponding in position to the heads of rivets 102.

As a result, to move to the locking position requires an elastic deformation of the small plate, until the heads of the rivets engage the above indentations, thus ensuring maintaining of the locking position.

Figure 4:
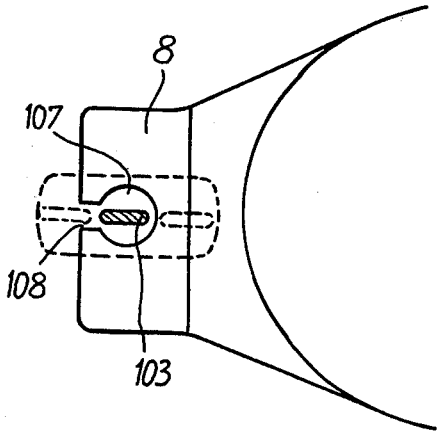
FIGS. 4 and 5 are schematic views along IV—IV of FIG. 2, showing the pin rspectively in the unlocking and locking positions in the recess in the forward extension of the sole.
Figure 5:
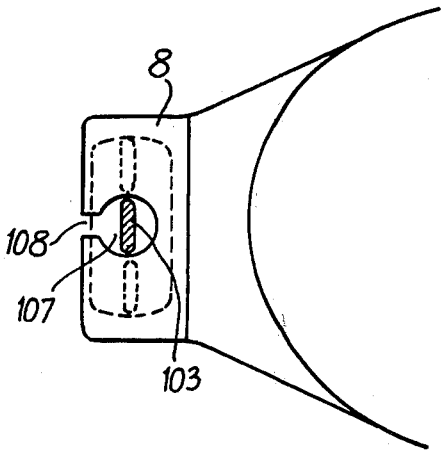

Conforming to the invention, the forward extension 8 of the sole of the boot has a recess or opening in the shape of a circular aperture 107, joined at the front of the extension by a slot 108. As FIGS. 4 and 5 clearly show, extension 8 of the sole can be disengaged from the arch plate when the pin is in the unlocking position shown in FIG. 4, because in this position the pin can slip out of slot 108, while in the locking position shown on FIG. 5, the pin which is transversely placed cannot escape through slot 108, thus ensuring the holding of the boot in the binding.

Thus by very simple means it is possible according to the invention to easily permit locking and unlocking of the forward extension of the sole of the boot in the fastening arch plate.

Of course the embodiment described above is in no way limiting and may undergo any desirable modification without exceeding the scope of the invention.

In particular, it goes without saying that the recess may have a different shape, provided that for one angular orientation of the pin, it allows the disengagement of the extension of the sole, while for another angular position of the pin, it does not allow such disengagement.

What is claimed is:

1. A ski binding of the type in which a boot is fastened to a ski by an extension of the sole of the boot and which extension engages an arch plate fixed to the ski, the arch plate having a shape corresponding in width and height to that of the extension, the extension having a recess comprising an inlet at the front of the extension communicating with an opening formed in the extension and of a size larger than inlet, the boot being secured to the ski by a locking means which locks the extension in the arch plate, said locking means comprising, a bar rotatable around an axis and extending vertically in the arch plate, said bar being rotatable, between a first angular position in which the binding is unlocked and said bar can pass through the inlet of the extension during forward insertion of the extension into the arch plate, and a second angular position in which the binding is locked and said bar engages a wall of said opening in the extension to prevent rearward withdrawal of the extension from the arch plate.

2. A ski binding according to claim 1, in which the bar has an essentially rectangular section.

3. A ski binding according to claim 1 wherein, an upper portion of the bar has two wings which allow it to be rotated.

4. A device according to any one of claims 1, 2 or 3, further comprising means for retaining said bar in said second position.

5. A ski binding according to claims 1, 2 or 3 in combination with a ski boot having said extension with said inlet and recess formed therein.

6. A ski boot comprising, a sole, an extension projecting from the sole forwardly of a toe portion of the boot, said extension being adapted to engage in an archplate of a binding having an opening of essentially the same cross-sectional shape as the extension, said extension having a recess comprising an inlet at the front of the extension communication with an opening formed in the extension and of a size larger than said inlet, said inlet being adapted to receive therethrough, a locking bar of the binding during insertion of the extension into the archplate of the binding, and said opening of said extension presenting a wall adapted to be engaged by the locking bar upon rotation thereof to a locking position to fasten the boot against rearward withdrawal from the binding.

7. A ski boot according to claim 6 in which the recess comprises a circular opening communicating with an inlet in the form of a slot.

8. A ski boot according to claim 6 wherein said extension comprises an extension of the sole made in one piece with the sole.

* * * * *